US009949599B2

(12) United States Patent
Harris

(10) Patent No.: US 9,949,599 B2
(45) Date of Patent: Apr. 24, 2018

(54) VENT VALVES AND REFILL UNITS WITH VENT VALVES FOR USE WITH INVERTED NON-COLLAPSING CONTAINERS

(71) Applicant: GOJO Industries, Inc., Akron, OH (US)

(72) Inventor: Donald R. Harris, Tallmadge, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/178,755

(22) Filed: Jun. 10, 2016

(65) Prior Publication Data

US 2016/0367083 A1 Dec. 22, 2016

Related U.S. Application Data

(60) Provisional application No. 62/180,939, filed on Jun. 17, 2015.

(51) Int. Cl.

| | |
|---|---|
| ***A47K 5/12*** | (2006.01) |
| *B05B 11/00* | (2006.01) |
| *A47K 5/14* | (2006.01) |

(52) U.S. Cl.

CPC ..... *A47K 5/1211* (2013.01); *A47K 5/1208* (2013.01); *B05B 11/0018* (2013.01); *B05B 11/0054* (2013.01); *B05B 11/3032* (2013.01); *B05B 11/3046* (2013.01); *A47K 5/14* (2013.01); *B05B 11/001* (2013.01)

(58) Field of Classification Search

CPC ..... A47K 5/1211; A47K 5/14; A47K 5/1208; B05B 11/0018; B05B 11/0054; B05B 11/3046; B05B 7/0025; B05B 11/3069; B05B 11/0016; B05B 11/0024; B67D 7/76; B65D 88/54

USPC ..... 222/190, 181.1, 80–91, 185.1, 481.5

See application file for complete search history.

(56) References Cited

U.S. PATENT DOCUMENTS 5,037,006 A * 8/1991 Kock ..... A47K 5/14 222/190
5,086,950 A * 2/1992 Crossdale ..... B67D 3/0019 222/185.1
6,142,750 A * 11/2000 Benecke ..... A47L 13/20 222/383.2

(Continued)

FOREIGN PATENT DOCUMENTS

GB 190507855 A 3/1906

OTHER PUBLICATIONS

Office Action for U.S. Appl. No. 14/628,478 dated Aug. 31, 2017.

*Primary Examiner* — Nicholas J Weiss
*Assistant Examiner* — Andrew P Bainbridge
(74) *Attorney, Agent, or Firm* — Calfee, Halter & Griswold LLP

(57) ABSTRACT

An exemplary refill unit for a dispenser includes an inverted non-collapsing container for holding a liquid. A pump housing is secured to the bottom of the inverted non-collapsing container. The pump housing includes a pump chamber for pumping fluid out of the inverted non-collapsing container. The pump housing includes an annular venting chamber. The annular venting chamber has a floor with an opening therethrough. A vent valve is located within the venting chamber. The vent valve has a first wiper seal in contact with a wall of the annular venting chamber.

18 Claims, 2 Drawing Sheets

(56) References Cited

U.S. PATENT DOCUMENTS 6,378,742 B1 * 4/2002 Rohr ..... B67D 1/0835 222/482
6,669,060 B2 * 12/2003 De Laforcade ..... B05B 11/0018 137/854
7,021,494 B2 * 4/2006 Mazooji ..... A47K 3/281 222/181.1
7,048,136 B2 * 5/2006 Havens ..... B65D 51/1644 206/524.8
7,086,567 B1 8/2006 Ciavarella
7,303,099 B2 12/2007 Ophardt
7,325,704 B2 * 2/2008 Kasting ..... B05B 11/0016 222/321.4
7,461,762 B2 * 12/2008 Law ..... B05B 7/0025 222/137
8,272,539 B2 9/2012 Ophardt
8,360,286 B2 1/2013 Shi et al.
8,550,378 B2 * 10/2013 Mazooji ..... B05B 3/02 222/181.1
8,662,355 B2 3/2014 Spiegelberg
9,038,862 B2 * 5/2015 McNulty ..... B05B 7/0025 222/181.1
9,307,871 B2 4/2016 McNulty
9,504,360 B2 * 11/2016 Van Diepen ..... A47K 5/1201
9,648,992 B2 * 5/2017 Harris ..... B05B 11/0018
2005/0072805 A1 * 4/2005 Matthews ..... B05B 11/0016 222/190
2005/0224519 A1 * 10/2005 Law ..... B05B 7/0025 222/190
2005/0230414 A1 * 10/2005 Yoshida ..... B67D 3/0003 222/1
2010/0213220 A1 * 8/2010 Laible ..... B67D 7/0277 222/481.5
2013/0200073 A1 * 8/2013 Dong ..... B65D 47/248 220/258.2
2014/0054322 A1 * 2/2014 McNulty ..... A47K 5/14 222/190
2014/0158715 A1 6/2014 Wells
2014/0203047 A1 * 7/2014 McNulty ..... B05B 7/0025 222/190
2014/0367419 A1 * 12/2014 Harris ..... A47K 5/14 222/190
2015/0173568 A1 * 6/2015 Harris ..... A47K 5/1211 222/190
2015/0251841 A1 * 9/2015 McNulty ..... B05B 7/0025 222/325
2016/0029855 A1 * 2/2016 Harris ..... A47K 5/14 222/135
2017/0156550 A1 * 6/2017 Ciavarella ..... A47K 5/14
2017/0181584 A1 * 6/2017 Harris ..... A47K 5/1207

* cited by examiner

VENT VALVES AND REFILL UNITS WITH VENT VALVES FOR USE WITH INVERTED NON-COLLAPSING CONTAINERS

RELATED APPLICATIONS

This application claims priority to and the benefits of U.S. Non-Provisional Application Ser. No. 62/180,939, filed on Jun. 17, 2015 and titled VENT VALVES AND REFILL UNITS WITH VENT VALVES FOR USE WITH INVERTED NON-COLLAPSING CONTAINERS, and which is incorporated herein by reference in its entirety.

TECHNICAL FIELD

The present invention relates generally to vent valves, pumps and refill units, and more particularly to vent valves, pumps and refill units having inverted non-collapsing containers.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles by use of an air pump or air compressor. Many liquid and foam dispensers use non-collapsing containers. Non-collapsing containers must be vented when fluid is pumped out of the container or the container will collapse and/or prevent the pump from dispensing the fluid. When the non-collapsing containers are used in an inverted position with the pump located at the bottom of the container, prior art vent valves tend to leak or have a high cracking pressure to prevent leaking, which causes collapsing or partial collapsing of thin containers.

Depending on the type of material the container is made of, certain non-collapsing containers, such as those made from PET, are very sensitive to thickness for collapsing. Accordingly, if the valve has a high cracking pressure, the container either collapses/partially collapses or has to be made with thick walls. In addition, vent valves with higher cracking pressure may cause inconsistent product output. Collapsed or partially collapsed containers are less aesthetically pleasing and containers with thicker walls are not environmentally friendly.

SUMMARY

Exemplary embodiments of vent valves, pumps and refill units are disclosed herein. An exemplary refill unit for a dispenser includes an inverted non-collapsing container for holding a liquid. A pump housing is secured to the bottom of the inverted non-collapsing container. The pump housing includes a pump chamber for pumping fluid out of the inverted non-collapsing container. The pump housing includes an annular venting chamber. The annular venting chamber has a floor with an opening therethrough. A vent valve is located within the venting chamber. The vent valve has a first wiper seal in contact with a wall of the annular venting chamber.

Another exemplary refill unit for a dispenser includes an inverted non-collapsing container for holding a liquid and a pump housing secured to the bottom of the inverted non-collapsing container. The pump housing has a pump chamber for pumping fluid out of the inverted non-collapsing container. In addition, the pump housing has an annular venting chamber. The annular venting chamber has a floor with an opening therethrough. A vent valve is located within the venting chamber. The vent valve has a first wiper seal in contact with a wall of the annular venting chamber and a second wiper seal in contact with the wall of the annular venting chamber.

Another exemplary refill unit for a dispenser includes an inverted non-collapsing container for holding a liquid and a pump housing secured to the bottom of the inverted non-collapsing container. The pump housing has a pump chamber for pumping fluid out of the inverted non-collapsing container. In addition, the pump housing has an annular venting chamber. The annular venting chamber has a floor with an opening therethrough. A vent valve is located within the venting chamber. The vent valve has a wiper seal in contact with a wall of the annular venting chamber and an annular base in contact with the floor of the annular venting chamber. The annular base extends outward from the base of the wiper seal.

BRIEF DESCRIPTION OF THE DRAWINGS

These and other features and advantages of the present invention will become better understood with regard to the following description and accompanying drawings in which.

DETAILED DESCRIPTION

Exemplary embodiments of vent valves, pumps and refill units having inverted non-collapsing containers are disclosed herein. The exemplary embodiments of vent valves may be used in conjunction with liquid pumps, foam pumps, refill units with non-collapsing containers and other applications.

Figure 1:
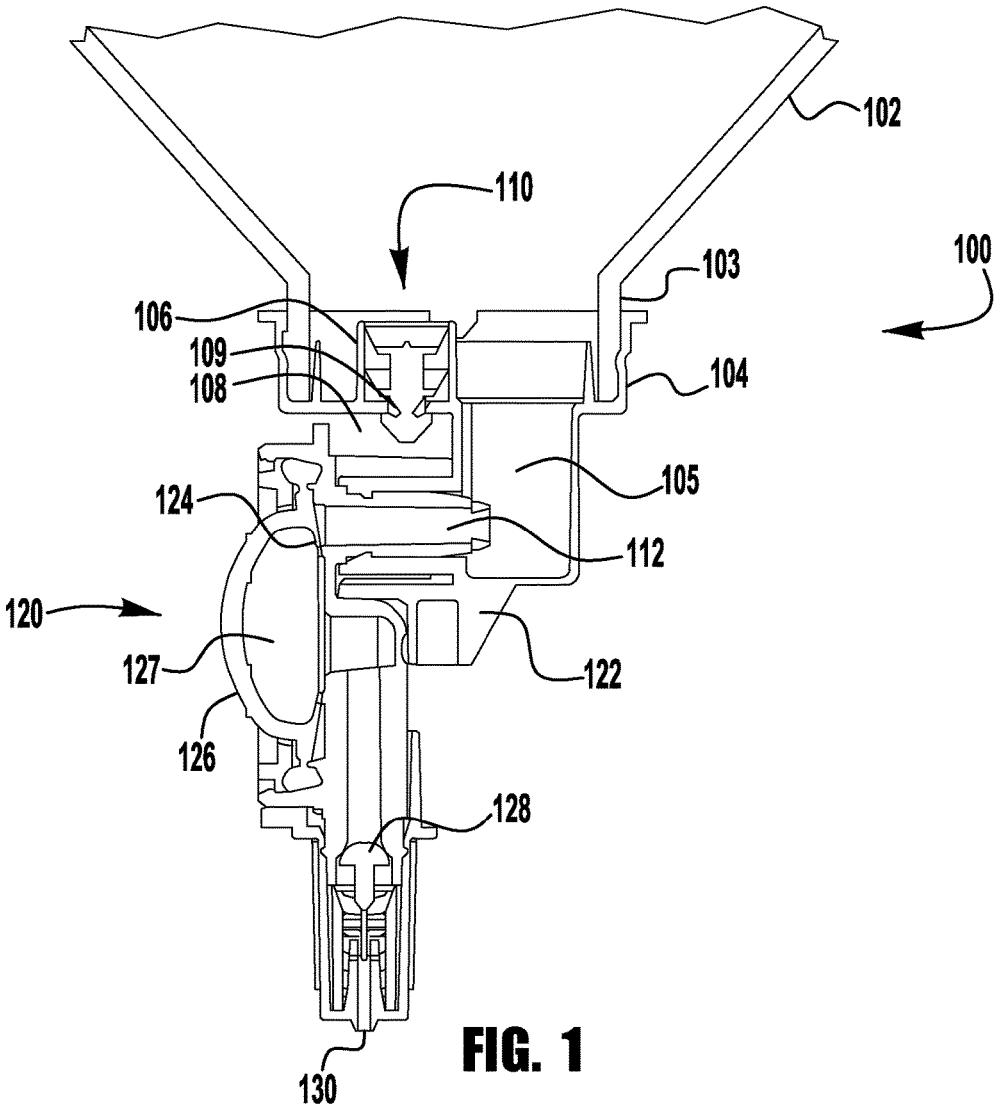
FIG. 1 illustrates a cross-section of an exemplary embodiment of a refill unit having a vent valve.

FIG. 1 is a partial cross-section of an exemplary embodiment of a refill unit 100. Refill unit 100 includes a non-collapsing container 102 that is in an inverted position and has a neck 103 (and opening) located at the bottom. The top portion (not shown) of container 102 is closed and the only opening is located at the bottom of the container 102.

Secured to the neck 103 of container 102 is pump housing 104. Pump housing 104 is secured to container neck 103 by a snap-fit connection. However, pump housing 104 may be connected to container neck 103 by any means, such as, for example, a threaded connection, a welded connection, a friction fit connection or the like.

Figure 2:
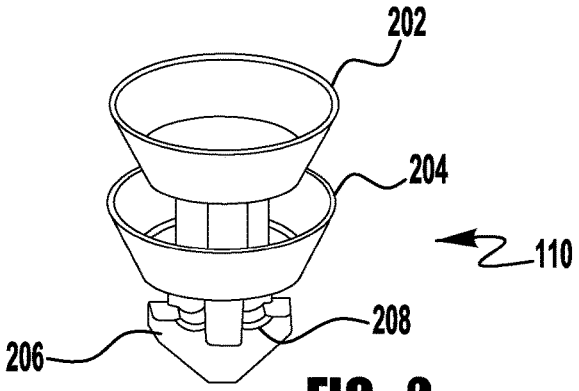
FIG. 2 is an isometric view of the exemplary vent valve of FIG. 1.

Pump housing 104 includes a liquid inlet passage 105. In addition, pump housing 104 includes an annular venting chamber 106 and an opening 109. A vent air passage 108 extends from the open atmosphere to opening 109. Vent valve 110 is located within venting chamber 106 and includes a first wiper seal 202 (FIG. 2), a second wiper seal 204 and a valve retention member 206. Valve retention member 206 includes one or more recess 208 to allow air to flow up through opening 109. Retention member 206 is forced through opening 109 to retain vent valve 110 in place.

First wiper seal 202 and second wipe seal 204 contact the walls of venting chamber 106 and provide a liquid tight seal that prevents liquid from flowing out of the container 102 through opening 109 and vent air passage 108.

Depending on the type of material the container is made of, certain non-collapsing containers, such as those made from PET, are very sensitive to thickness for collapsing. Vent valves, such as umbrella vent valves, have high cracking pressures and may cause collapsing of the container. Thus, either the container will collapse or the walls of the container must be made of thicker material.

Exemplary embodiments of the vent valves disclosed herein have low cracking pressures. In some embodiments, the cracking pressure is less than about 30 millibar. In some embodiments the cracking pressure is less than about 25 millibar. In some embodiments the cracking pressure is less than about 20 millibar.

A vent valve that has a single wiper seal and a low cracking pressure may tilt when inserted into the venting chamber 109 and leak during shipping. The two wiper seal 202, 204 provides a number of advantages. First, the potential tilt issue is eliminated due to additional surface contact between the two wiper seals 202, 204 and the walls of the venting chamber 109. In addition, the two wiper seals 202, 204 cause the vent valve 110 to self center and properly align. If some fluid leak past first wiper seal 202 it is trapped by wiper seal 204 and does not leak out of the refill unit 100. In addition, if fluid is trapped between wiper seal 202 and wiper seal 204 the fluid tends to be drawn back into container 102 the next time container 102 builds up enough pressure to break the cracking pressure of vent valve 110 and vent. Vent valve 110 results in a uniform seal pressure and leads to consistent cracking pressures.

Secured to pump housing 104 is a liquid pump 120. Liquid pump 120 is a dome pump; however, as described below, venting valve 110 may be used with any pumps, such as a foam pump, a piston pump, a bellows pump and the like. Liquid pump 120 includes a liquid inlet 122 in fluid communication with liquid inlet chamber 105. Liquid pump 120 includes a liquid inlet valve 124, a liquid outlet valve 128 and a liquid outlet 130. A compressible pump chamber 127 is formed in part by resilient dome 126. Resilient dome 126 may be compressed to close liquid inlet valve 124, open liquid outlet valve 128 and dispense liquid. As liquid is removed from the container, vacuum pressure builds up. Once the vacuum pressure is higher than the cracking pressure of vent valve 110, vent valve 110 opens and allows air to vent container 102. Resilient dome 126 returns to its uncompressed position to draw liquid into the compressible pump chamber 127.

Figure 3:
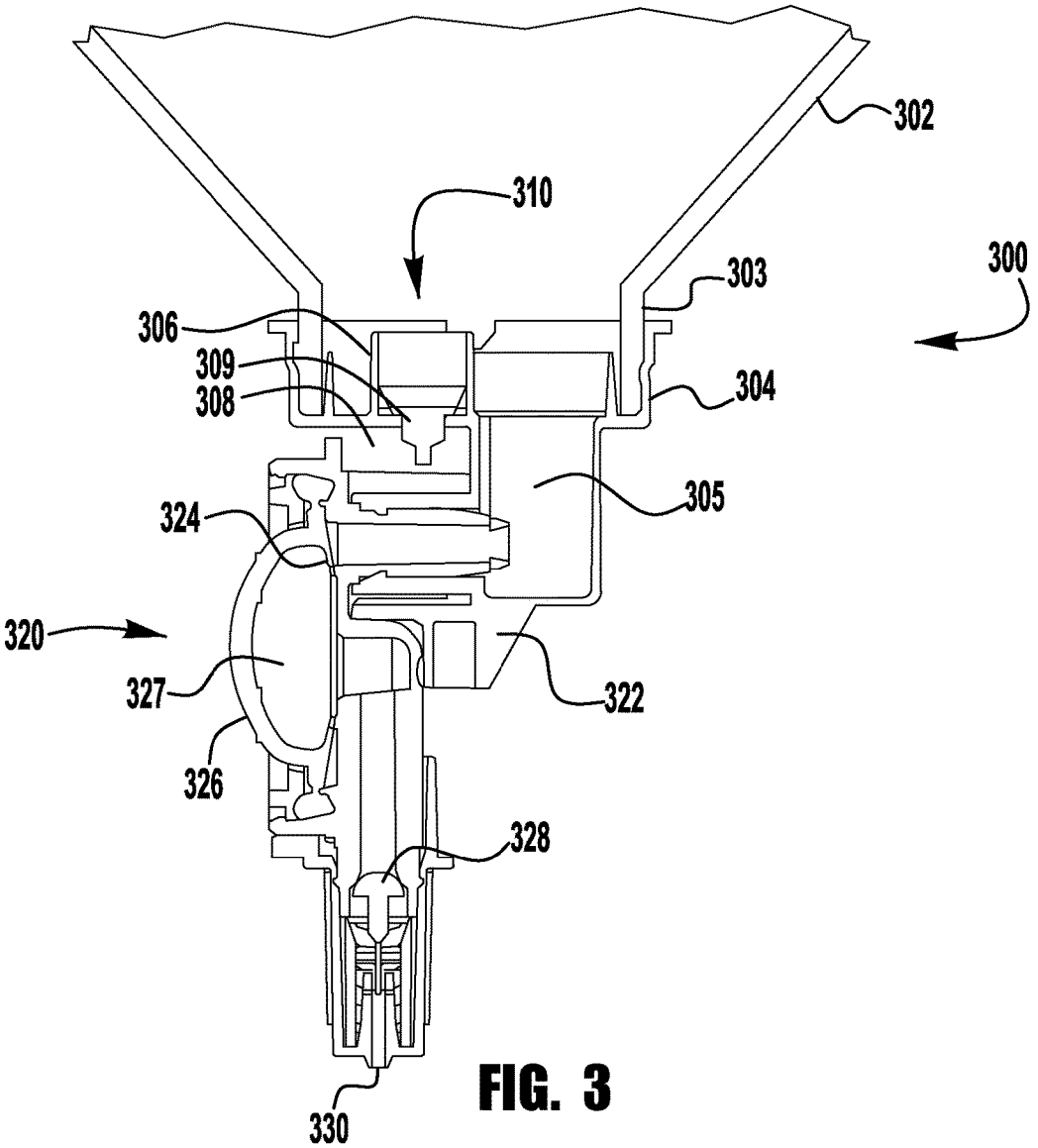
FIG. 3 illustrates a cross-section of another exemplary embodiment of a refill unit having a vent valve.

FIG. 3 is a partial cross-section of an exemplary embodiment of a refill unit 300. Refill unit 300 includes a non-collapsing container 302 that is in an inverted position with the neck 303 (and opening) located at the bottom. The top portion (not shown) of container 302 is closed and the only opening is located at the bottom of the container 302.

Secured to the neck 303 of container 302 is pump housing 304. Pump housing 304 is secured to container neck 303 by a snap-fit connection, however, pump housing 304 may be connected to container neck 303 by any means, such as, for example, a threaded connection, a welded connection, a friction fit connection or the like.

Figure 4:
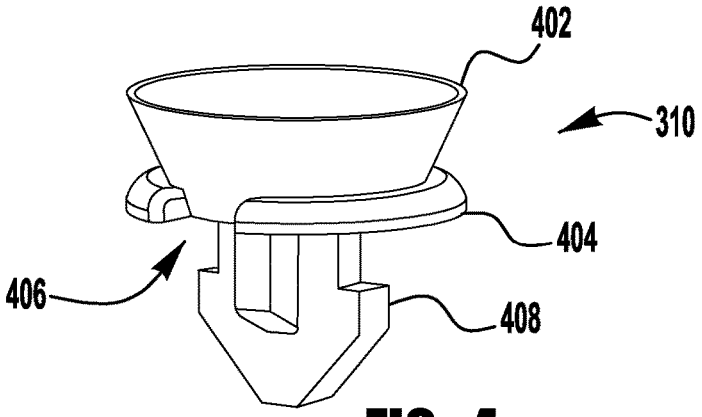
FIG. 4 is an isometric view of the exemplary vent valve of FIG. 3.

Pump housing 304 includes a liquid inlet passage 305. In addition, pump housing 304 includes an annular venting chamber 306 and an opening 309. A vent air passage 308 extends from the open atmosphere to opening 309. Vent valve 310 is located within venting chamber 306 and includes a wiper seal 402 (FIG. 4), an annular base 404, a vent opening 406, and a valve retention member 408. The annular base 404 extends outward from the base of the wiper seal. Retention member 408 is forced through opening 309 to retain vent valve 310 in place and ensures the annular base 404 is flush against the floor around opening 309.

Wiper seal 402 contacts the wall of venting chamber 306. Provided that valve 310 is properly positioned and has even contact pressure entirely around wiper seal 402, valve 310 provides a liquid tight seal that prevents liquid from flowing out of the container 302 through opening 309 and the vent air passage 308.

Annular base 404 contacts the floor of pump housing around opening 309 and ensures that valve 310 is properly positioned in venting chamber 306 and that there is even contact pressure entirely around wiper seal 402. Annular base 404 also prevents tilting of valve 310 and ensures a liquid tight seal. In addition, annular base 404 includes one or more air passages 406 to allow air to flow through opening 309 past annular base 404.

Exemplary embodiments of the vent valve 310 have low cracking pressures. In some embodiments, the cracking pressure is less than about 30 millibar. In some embodiments the cracking pressure is less than about 45 millibar. In some embodiments the cracking pressure is less than about 40 millibar. The design of vent valve 310 results in a uniform seal pressure and leads to consistent cracking pressures.

Secured to pump housing 304 is a liquid pump 320. Liquid pump 320 is a dome pump; however, as described below, venting valve 310 may be used with any pumps, such as a foam pump, a piston pump, a bellows pump and the like. Liquid pump 320 includes a liquid inlet 322 in fluid communication with liquid inlet chamber 305. Liquid pump 320 includes a liquid inlet valve 324, a liquid outlet valve 328 and a liquid outlet 330. A compressible pump chamber 327 is formed in part by resilient dome 326. Resilient dome 326 may be compressed to close liquid inlet valve 324, open liquid outlet valve 328 and dispense liquid. Once enough liquid is pumped out of container 302 and a high enough vacuum pressure is achieved, valve 310 cracks and vents container 302. Resilient dome 326 returns to its uncompressed position to draw liquid into the compressible pump chamber 327.

In addition to providing a leak free refill unit with an inverted non-collapsing container, the exemplary vent valves 110, 310 allow for the inverted non-collapsing containers to be made thinner thereby reducing the amount of plastic material used, which results in a more cost effective product and is more environmentally friendly.

Although the vent valves 110, 310 are shown and described in conjunction with dome pumps 120, 320 that pump liquid, the exemplary vent valves 110, 310 may be used with many types of conventional pumps used today for the dispensing of soap and sanitizers. Exemplary embodiments of liquid and foam pumps that may be used with, or modified to be used with the exemplary embodiments of vent valves include, for example, U.S. patent application Ser. No. 13/208,076, titled Split Body Pumps for Foam Dispensers and Refill Units, filed on Aug. 11, 2011; U.S. Provisional patent application Ser. No. 13/792,034, titled Horizontal Pumps, Refill Units and Foam Dispensers With Integral Air Compressors, filed on Mar. 9, 2013; U.S. Provisional patent application Ser. No. 13/792,115, titled Horizontal Pumps, Refill Units and Foam Dispensers, filed on Mar. 10, 2013; U.S. Pat. No. 7,303,099, titled Stepped Pump Foam Dispenser filed on Jun. 6, 2005; U.S. Pat. No. 8,272,539, titled Angled Slot Foam Dispenser file on Dec. 3, 2008; and U.S. Pat. No. 8,360,286, titled Draw Back Push Pump, filed on Jul. 7, 2010, each of which is incorporated herein by reference.

Similarly, the exemplary vent valves 110, 310 may be used in any dispenser system, such as, for example, U.S. Pat. No. 8,668,116, titled Pump Having A Flexible Mechanism For Engagement With A Dispenser filed on Sep. 11, 2009 and U.S. Pat. No. 7,086,567, titled Wall-Mounted Dispenser Assembly With Transparent Window, filed on Jul. 25, 2002, which are incorporated herein by reference.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A refill unit for a dispenser comprising:

an inverted non-collapsing container for holding a liquid;

a pump housing secured to the bottom of the inverted non-collapsing container;

the pump housing having a pump chamber for pumping fluid out of the inverted non-collapsing container;

the pump housing having an annular venting chamber;

the annular venting chamber having a floor with an opening therethrough and a cylindrical wall;

a vent valve located within the venting chamber;

wherein the vent valve has a first wiper seal in contact with an inside surface of the cylindrical wall of the annular venting chamber; and wherein the inside surface of the cylindrical wall extends above the top of the first wiper seal; and wherein the vent valve has a stem that extends below the floor.

2. The refill unit of claim 1 further comprising a second wiper seal in contact with the wall of the annular venting chamber.

3. The refill unit of claim 1 wherein the vent valve includes an annular base in contact with the floor of the annular venting chamber and wherein the annular base extends outward from the base of the wiper seal, and wherein the base at least partially covers the opening in the floor of the venting chamber.

4. The refill unit of claim 3 wherein the annular base comprises one or more air passage therethrough.

5. The refill unit of claim 1 wherein vent valve has a cracking pressure of less than about 30 millibar.

6. The refill unit of claim 1 wherein vent valve has a cracking pressure of less than about 25 millibar.

7. The refill unit of claim 1 wherein vent valve has a cracking pressure of less than about 20 millibar.

8. A refill unit for a dispenser comprising:

an inverted non-collapsing container for holding a liquid;

a pump housing secured to the bottom of the inverted non-collapsing container;

the pump housing having a pump chamber for pumping fluid out of the inverted non-collapsing container;

the pump housing having an annular venting chamber;

the annular venting chamber having a floor with an opening therethrough;

a vent valve located within the venting chamber;

wherein the vent valve has a first wiper seal in contact with a cylindrical wall of the annular venting chamber; and a second wiper seal in contact with the cylindrical wall of the annular venting chamber;

a stem that extend below the floor and retains the vent valve in place; and wherein the cylindrical wall extends above the first wiper seal; and wherein air flows past the first and second wiper seal into the inverted non-collapsing container.

9. The refill unit of claim 8 wherein a surface of the first wiper seal is in contact with fluid when fluid is located in the non-collapsing container.

10. The refill unit of claim 8 wherein vent valve has a cracking pressure of less than about 30 millibar.

11. The refill unit of claim 8 wherein vent valve has a cracking pressure of less than about 25 millibar.

12. The refill unit of claim 8 wherein vent valve has a cracking pressure of less than about 20 millibar.

13. A refill unit for a dispenser comprising:

an inverted non-collapsing container for holding a liquid;

a pump housing secured to the bottom of the inverted non-collapsing container;

the pump housing having a pump chamber for pumping fluid out of the inverted non-collapsing container;

the pump housing having an annular venting chamber;

the annular venting chamber having a floor with an opening therethrough and an cylindrical wall;

a vent valve located within the venting chamber;

wherein the vent valve has a first wiper seal in contact with an inside surface of the cylindrical wall of the annular venting chamber; and an annular base in contact with the floor of the annular venting chamber;

wherein the annular base extends outward from the base of the wiper seal;

the vent valve having a stem that extends below the floor of the annular venting chamber and retains the vent valve in place; and wherein the inside surface of the cylindrical wall extends above the top of the vent valve.

14. The refill unit of claim 13 wherein the annular base includes one or more air passages.

15. The refill unit of claim 13 wherein a surface of the first wiper seal is in contact with fluid located in the non-collapsing container.

16. The refill unit of claim 13 wherein vent valve has a cracking pressure of less than about 30 millibar.

17. The refill unit of claim 13 wherein vent valve has a cracking pressure of less than about 25 millibar.

18. The refill unit of claim 13 wherein vent valve has a cracking pressure of less than about 20 millibar.

* * * * *